US008757617B2

(12) United States Patent
Fukusada

(10) Patent No.: US 8,757,617 B2
(45) Date of Patent: Jun. 24, 2014

(54) SHEET FEED TIMING

(71) Applicant: Brother Kogyo Kabushiki Kaisha, Nagoya (JP)

(72) Inventor: Yuki Fukusada, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/767,399

(22) Filed: Feb. 14, 2013

(65) Prior Publication Data

US 2013/0207340 A1 Aug. 15, 2013

(30) Foreign Application Priority Data

Feb. 15, 2012 (JP) ..... 2012-030502

(51) Int. Cl.
*B65H 7/02* (2006.01)

(52) U.S. Cl.
USPC ..... 271/258.01; 271/265.01

(58) Field of Classification Search
USPC ..... 271/258.01, 265.01
See application file for complete search history.

(56) References Cited

U.S. PATENT DOCUMENTS

| | | | | |
|---|---|---|---|---|
| 3,951,264 | A * | 4/1976 | Heidecker et al. | 206/308.3 |
| 4,849,915 | A * | 7/1989 | Worsley et al. | 702/163 |
| 4,939,676 | A * | 7/1990 | Worsley et al. | 702/82 |
| 5,037,083 | A * | 8/1991 | Johdai et al. | 271/288 |
| 6,076,821 | A * | 6/2000 | Embry et al. | 271/10.01 |
| 6,554,275 | B1 * | 4/2003 | Tranquilla | 271/259 |
| 7,548,721 | B2 * | 6/2009 | Isozaki | 399/388 |
| 2010/0183351 | A1 * | 7/2010 | Uji et al. | 399/400 |
| 2010/0295241 | A1 * | 11/2010 | Isogai | 271/227 |

FOREIGN PATENT DOCUMENTS

| | | | |
|---|---|---|---|
| JP | 62175359 | A | 8/1987 |
| JP | 4266351 | A | 9/1992 |

* cited by examiner

*Primary Examiner* — David H Bollinger
(74) *Attorney, Agent, or Firm* — Banner & Witcoff, Ltd.

(57) ABSTRACT

An apparatus may be configured to: upon feeding a sheet by a roller, wait for a sheet waiting interval before feeding a next sheet by the roller, determine, using a sensor downstream from the roller in a sheet feeding path, a sensed sheet interval between at least two of the fed sheets; determine whether the sensed sheet interval is equal to or greater than a reference value; and in response to determining that the sensed sheet interval is equal to or greater than the reference value, reduce the sheet feed waiting interval for subsequent feeding of at least one sheet.

2 Claims, 5 Drawing Sheets

SHEET FEED TIMING

CROSS-REFERENCE TO RELATED APPLICATION

This application claims priority from Japanese Patent Application No. 2012-030502 filed on Feb. 15, 2012, which is incorporated herein by reference.

FIELD OF DISCLOSURE

The disclosure herein relates an apparatus configured to feed a sheet, an image forming device configured to feed a sheet and form image on the sheet, and a computer readable medium including a program for sheet feeding.

BACKGROUND

A known printer or copier includes a sheet supply device configured to supply a recording sheet to an image forming unit. The sheet supply device is configured to sequentially supply recording sheets while keeping a predetermined interval or distance between a trailing end of a previous recording sheet and a leading end of a next recording sheet.

In the sheet supply device, the predetermined distance may not be maintained due to a dimensional error of a diameter of a supply roller configured to feed a recording sheet or slip between a recording sheet and rollers.

For example, there is a sheet supply device including a recording sheet detection sensor configured to detect an interval or distance between a trailing end of a previous recording sheet and a leading end of a next recording sheet and a determination device configured to determine whether the detected interval or distance is longer than a predetermined interval or distance. When the determination device determines that the detected interval is longer than the predetermined interval, a supply speed of a next following recording sheet to be fed by the supply roller, e.g., rotation speed of the supply roller, is increased to reduce the interval between a trailing end of a previous recording sheet and a leading end of a next recording sheet. Nevertheless, to reduce the interval between a trailing end of a previous recording sheet and a leading end of a next recording sheet in the sheet supply device, a driving mechanism for the supply roller and a driving mechanism for a feeding roller disposed downstream of the supply roller in a sheet feeding direction need to be separately structured and separately controlled. Accordingly, motors need to be separately provided to drive the supply roller and the feeding roller, and several types of gear mechanisms to change the sheet supply speed by the supply roller and clutches to switch the gear mechanisms are required. This makes the driving mechanisms of the sheet supply device complicated.

SUMMARY

According to an aspect of this disclosure, there is provided an apparatus configured to: upon feeding a sheet by a roller, wait for a sheet feed waiting interval before feeding a next sheet by the roller; determine, using a sensor downstream from the roller in a sheet feeding path, a sensed sheet interval between at least two of the fed sheets; determine whether the sensed sheet interval is equal to or greater than a reference value; and in response to determining that the sensed sheet interval is equal to or greater than the reference value, reduce the sheet feed waiting interval for subsequent feeding of at least one sheet.

According to another aspect of this disclosure, there is provided an image forming device including: a roller configured to rotate and to convey a sheet; an image forming unit configured to form an image on the sheet conveyed by the roller; a sensor disposed between the roller and the image forming unit in the conveying direction and configured to detect the sheet; and a control device configured to: upon feeding a sheet by the roller, waiting for a sheet feed waiting interval before feeding a next sheet by the roller; determine, using the sensor, a sensed sheet interval between at least two of the fed sheets; determine whether the sensed sheet interval is equal to or greater than a reference value; and in response to determining that the sensed sheet interval is equal to or greater than the reference value, reduce the sheet feed waiting interval for subsequent feeding of at least one sheet.

According to still another aspect of this disclosure, there is provided a non-transitory, computer-readable medium storing a program including instructions for performing the steps of: upon feeding a sheet by a roller, waiting for a sheet feed waiting interval before feeding a next sheet by the roller; determining, using a sensor downstream from the roller in a sheet feeding path, a sensed sheet interval between at least two of the fed sheets; determining whether the sensed sheet interval is equal to or greater than a reference value; and in response to determining that the sensed sheet interval is equal to or greater than the reference value, reducing the sheet feed waiting interval for subsequent feeding of at least one sheet.

BRIEF DESCRIPTION OF THE DRAWINGS

Reference now is made to the following description taken in connection with the accompanying drawings.

DETAILED DESCRIPTION

Figure 1:
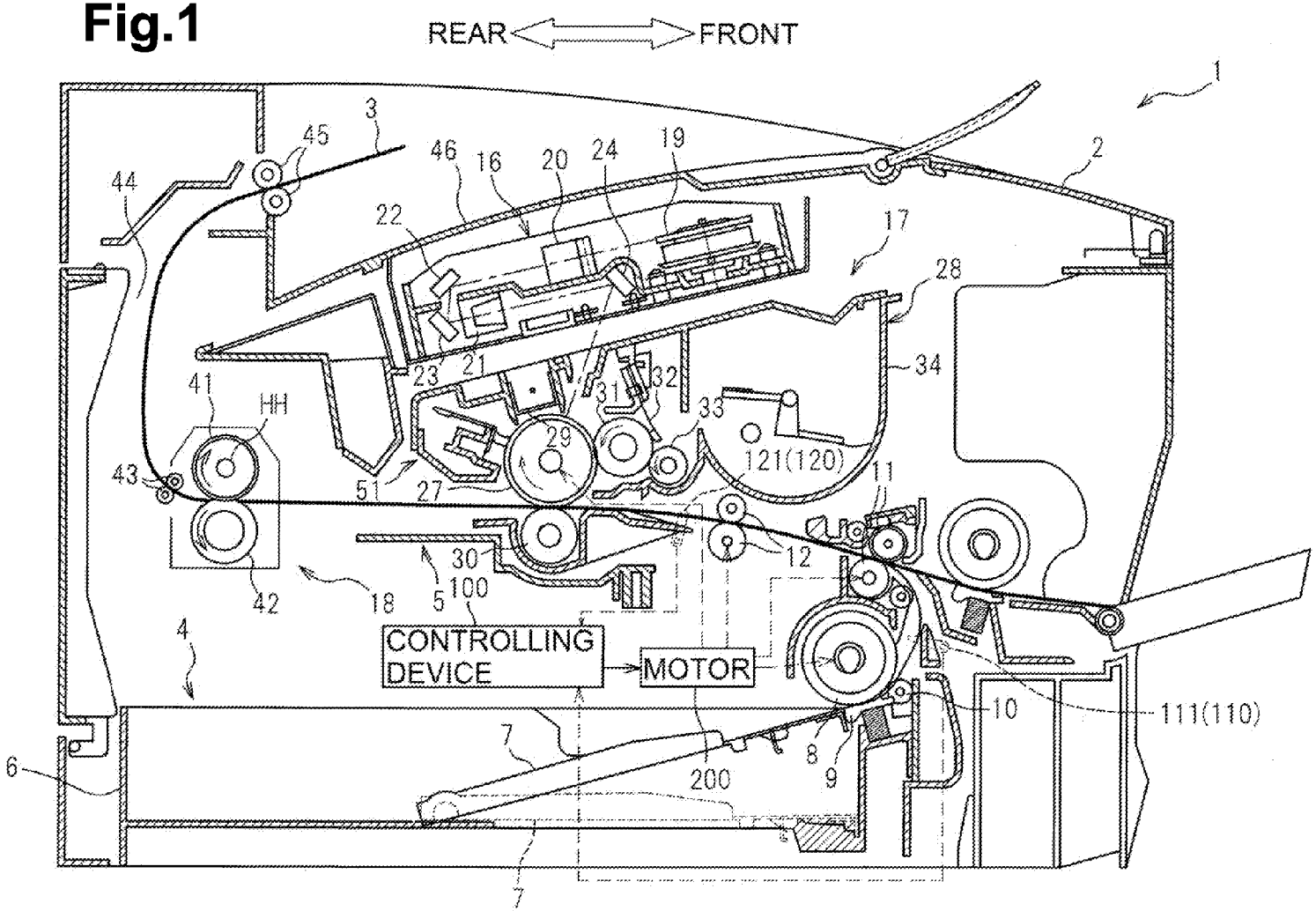
FIG. 1 is a side sectional view of a laser printer embodying one or more novel features described herein.

Embodiments are described in detail herein with reference to the accompanying drawings, like reference numerals being used for like corresponding parts in the various drawings.

In the following description, overall structure of an image forming apparatus, e.g., a laser printer 1, will be first described and then a specific portion will be described.

Hereinafter, a front, rear, top and bottom of the laser printer 1 may be defined in conjunction with an orientation in a user uses the laser printer 1, unless otherwise specified. More specifically, right, left, top, and bottom sides in FIG. 1 may be defined as front, rear, top, and bottom sides of the laser printer 1, respectively. Front and back sides of a sheet of FIG. 1 may be defined as left and right sides of the laser printer 1, respectively.

As depicted in FIG. 1, the laser printer 1 may comprise a main casing 2. A sheet supply device, e.g., a feeder section 4, configured to feed a sheet 3, and an image forming section 5 configured to form an image on the sheet 3 fed by the feeder section 4 may be disposed in the main casing 2.

The feeder section 4 may comprise a sheet placing portion, e.g., a sheet supply tray 6, and a paper pressure plate 7 disposed in the sheet supply tray 6. The sheet supply tray 6 may be a tray on which a stack of the sheets 3 may be placed. The sheet supply tray 6 may be removably disposed at a bottom portion of the main casing 2.

The feeder section 4 may further comprise a roller, e.g., a pick-up roller 8, a separation pad 9, a sheet dust removing rollers 10, 11, and registration rollers 12.

The pick-up roller 8 may be disposed above a front end portion of the paper pressure plate 7 when the sheet supply tray 6 is set in the main casing 2. Driving force from a drive source, e.g., a motor 200, may be transmitted to the pick-up roller 8, via a known driving force transmission switching mechanism. More specifically, a controlling device 100 may control the driving force transmission switching mechanism to allow and prohibit the transmission of the driving force from the motor 200 to the pick-up roller 8. Thus, the feeding timing of the sheet 3 by the pick-up roller 8 may be changed.

More specifically, the pick-up roller 8, the sheet dust removing rollers 11, and the registration rollers 12 may be driven by the same motor 200. Further, the driving force of the motor 200 may be transmitted to the registration rollers 12, via a known electromagnetic clutch. Given this structure, the registration rollers 12 may be stopped independently of the other rollers 8, 11.

The sheet dust removing rollers 10, 11 may be configured to remove sheet dust or fiber on the sheet 3. The sheet dust removing rollers 10, 11 may be disposed downstream of the pick-up roller 8 in a feeding direction of the sheet 3. The sheet dust removing roller 10 may be disposed upstream of the sheet dust removing roller 11. A first sheet sensor 110 configured to detect the sheet 3 may be disposed between the upstream-side sheet dust removing roller 10 and the downstream-side sheet dust removing rollers 11.

The registration rollers 12 may be configured to be temporarily stopped to correct or reduce the skew of the sheet 3 in the left and right direction. The registration rollers 12 may be disposed downstream of the sheet dust removing rollers 11 in the feeding direction. The registration rollers 12 may be configured to feed the sheet 3, which may have temporarily stopped as noted above, to a nip portion between a photosensitive drum 27 and a transfer roller 30 at a predetermined timing.

A sensor, e.g., a second sheet sensor 120, configured to detect the sheet 3 may be disposed between the registration rollers 12 and the photosensitive drum 27. The first sheet sensor 110 and the second sheet sensor 120 may comprise known structures. In brief, each of the first sheet sensor 110 and the second sheet sensor 120 may comprise a detection arm 111, 121, respectively, configured to move as the sheet 3 contacts thereto and an optical sensor configured to detect the movement of the detection arm 111, 121.

In the feeder section 4 as structured above, an end of a stack of the sheets 3 placed in the sheet supply tray 6 may be raised by the paper pressure plate 7 toward the pick-up roller 8 when the sheet supply tray 6 is set in the main casing 2. The sheets 3 may be picked up and separated one by one by the pick-up roller 8 and the separation pad 9. The sheets 3 may be fed to the image forming section 5 through various rollers 10-12, while making U-turn in a front portion of the main casing 2. Thus, the sheet 3 may be fed from the front side to the rear side of the main casing 2 toward the image forming section 5.

The image forming section 5 may comprise a scanner unit 16, a process cartridge 17, and a fixing unit 18.

The scanner unit 16 may be disposed at an upper portion of the main casing 2. The scanner unit 16 may comprise a laser emitting section (not depicted), a polygon mirror 19 that is driven so as to spin, lenses 20, 21, reflecting mirrors 22, 23, and 24. As depicted by broken lines in FIG. 1, the laser beam emitted from the scanner unit 16 may scan at high speed across a surface of the photosensitive drum 27 of a process cartridge 17.

The process cartridge 17 may be removably disposed below the scanner unit 16 in the main casing 2. The process cartridge 17 may comprise a developing cartridge 28 and a drum unit 51.

The developing cartridge 28 may comprise a developing roller 31, a toner thickness regulating blade 32, a toner supply roller 33, and a toner hopper 34. Toner in the toner hopper 34 may be agitated by an agitator 35 and supplied by the toner supply roller 33 to the developing roller 31. At this time, the toner may be positively charged by the friction between the toner supply roller 33 and the developing roller 31. The toner supplied to the developing roller 31 may enter between the toner thickness regulating blade 32 and the developing roller 31 in accordance with the rotation of the developing roller 31. The toner may be carried on the developing roller 31 as a thin layer whose thickness is uniform.

The drum unit 51 may comprise a photosensitive member, e.g., the photosensitive drum 27, a scorotron charger 29, and a transfer member, e.g., a transfer roller 30. In the drum unit 51, a surface of the photosensitive drum 27 may be uniformly and positively charged by the scorotron charger 29. Then, the surface of the photosensitive drum 27 may be exposed to the laser beam emitted from the scanner unit 16 to scan the surface of the photosensitive drum 27 at high speed, thereby forming an electrostatic latent image on the photosensitive drum 27. More specifically, the electrostatic latent image may be formed, based on image data, on a part of the surface of the photosensitive drum 27 where the potential level is more lowered than the remaining part of the photosensitive drum 27, due to exposure to the laser beam.

Then, as the toner, which may be carried on the developing roller 31, makes contact with the photosensitive drum 27 in accordance with the rotation of the developing roller 31, the toner may be supplied to the electrostatic latent image formed on the surface of the photosensitive drum 27. The electrostatic latent image on the photosensitive drum 27 may be made visible by the toner selectively carried on the photosensitive drum 27. Thus, a toner image may be formed on the photosensitive drum 27 by reversal development. Thereafter, the sheet 3 may be fed in the feeding direction while being held between the photosensitive drum 27 and the transfer roller 30, the toner image carried on the surface of the photosensitive drum 27 may be transferred onto the sheet 3.

The fixing unit 18 may comprise a heat roller 41 accommodating a halogen heater HH therein and a pressure roller 42 pressed by the heat roller 41. In the fixing unit 18, the heat roller 41 may be heated by the halogen heater HH. The toner image transferred on the sheet 3 may be thermally fixed to the sheet 3 while the sheet 3 passes between the heat roller 41 and the pressure roller 42. Thereafter, the sheet 3 may be fed by feeding rollers 43 to an output path 44, and output onto an output tray 46 by output rollers 45.

The laser printer 1 may comprise calculating and controlling devices, e.g., the controlling device 100, as depicted in FIG. 1. The controlling device 100 may comprise a central processing unit (CPU), a random access memory (RAM), a read-only memory (ROM) and an input/output circuit. The controlling device 100 may be configured to perform a printing operation and timing control for feeding the sheets 3 by the pick-up roller 8, by performing calculations based on inputs from the first sheet sensor 110 and the second sheet sensor 120, contents of a print instruction, or programs and data stored in the ROM.

More specifically, the controlling device 100 may have a function to calculate based on detection by the second sheet sensor 120, an interval (e.g., a time interval or distance) between a trailing end of the previous sheet 3 fed by the pick-up roller 8 and a leading end of the next sheet 3 (hereinafter, such interval or distance may be simply referred to as the sheet interval). More specifically, the controlling device 100 may determine that the leading end of the sheet 3 has passed the second sheet sensor 120 when the second sheet sensor 120 is, for example, turned on from a turn-off state. The controlling device 100 may determine that the trailing end of the sheet 3 has passed the second sheet sensor 120 when the second sheet sensor 120 is turned off from a turn-on state. Given this structure, the controlling device 100 may calculate the sheet interval, based on the time from when the second sheet sensor 120 is turned off from the turn-on state, to when the second sheet sensor 120 is turned on again.

The controlling device 100 may determine a sheet interval as a time value, or it may calculate it as a distance calculated based on the above-described time and the feeding speed of the sheet 3 as the sheet interval.

The controlling device 100 may further have a function to reduce a sheet feed waiting interval of the next sheet 3 by the pick-up roller 8 when the calculated sheet interval is equal to or greater than a predetermined reference value. The sheet feed waiting interval herein may refer to the time from when the first sheet sensor 110 detects the trailing end of the previous sheet 3 to the time when the next sheet 3 is fed by the pick-up roller 8.

More specifically, the controlling device 100 may be configured to feed the sheet 3 after waiting for a predetermined time, e.g., an initial value of a sheet feeding waiting interval, from when the first sheet sensor 110 detects the trailing end of the previous sheet 3. The initial value may be set according to types, e.g., sizes or thicknesses, of the sheets 3. When the calculated sheet interval is equal to or greater than the predetermined reference value, the controlling device 100 may change the sheet feeding waiting interval for a subsequent sheet to a shorter time than the initial value, to reduce the feeding timing.

When the sheet interval becomes equal to or greater than the predetermined reference value, the controlling device 100 may reduce the sheet feeding waiting interval of future sheets 3 by the pick-up roller 8 . Thus, a mechanism for changing the rotation speed of a roller, which may be provided for a known image forming apparatus, may be unnecessary, leading to simplification of the driving mechanism for the pick-up roller 8.

The controlling device 100 may be configured to reset the sheet feed waiting interval of the next sheet 3 by the pick-up roller 8 to the initial value, every time a printing operation is finished. Thus, for example, even when a different type, e.g., sizes or thicknesses, of the sheet 3 is set in the laser printer 1 after a printing operation is finished, the sheet feed waiting interval may be reset to the initial value, which may be set according to types of the sheets 3. Therefore, the next printing operation may be executed with the proper sheet interval.

Figure 2:
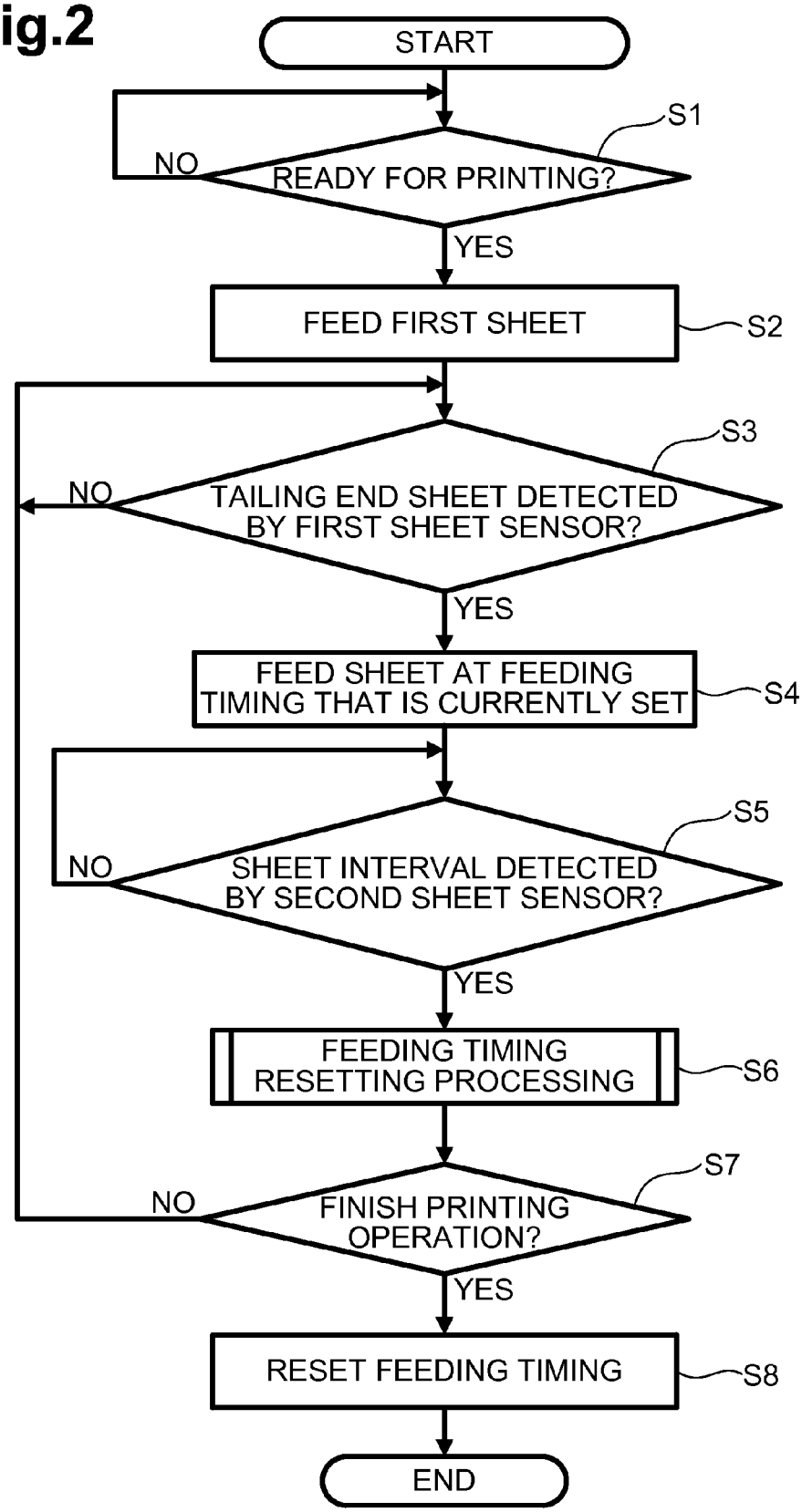
FIG. 2 is a flowchart depicting operations of a controlling device of the laser printer.
Figure 3:
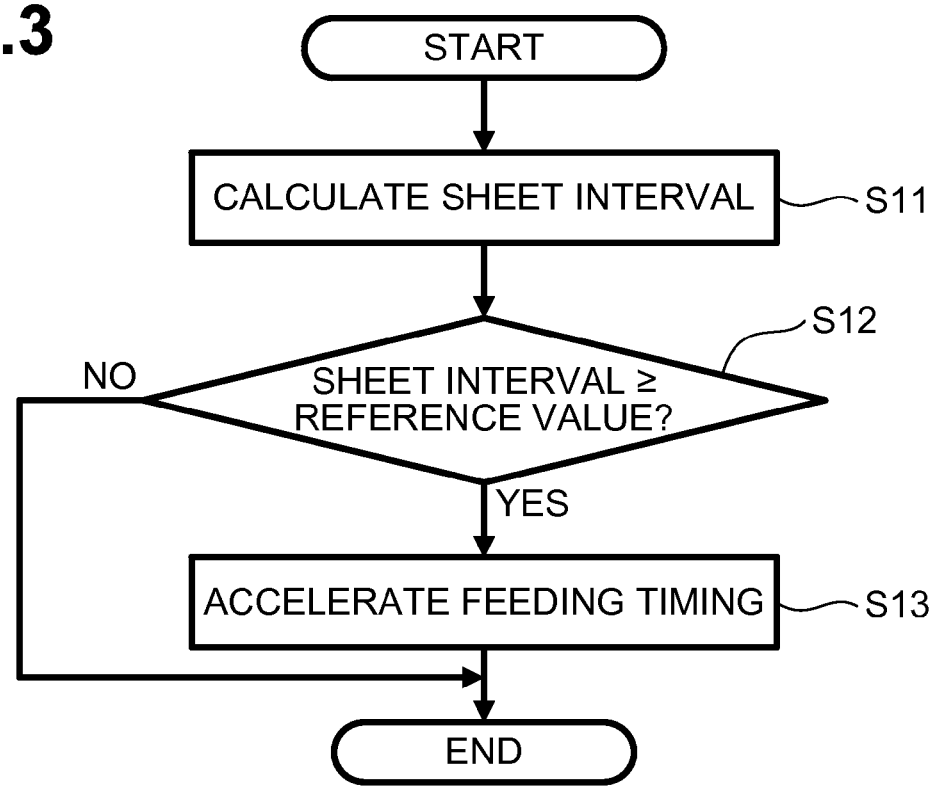
FIG. 3 is a flowchart depicting processes of a feeding timing resetting processing.

More specifically, the controlling device 100 may perform operations in accordance with flowcharts depicted in FIGS. 2 and 3. When the controlling device 100 receives a print instruction from a personal computer (not depicted), the controlling device 100 may be configured to perform the control in accordance with flowchart depicted in FIG. 2.

When the controlling device 100 receives a print instruction (START), the controlling device 100 may determine whether the image forming section 5, e.g., the fixing unit 18, is ready for printing (step S1). When the controlling device 100 determines that the image forming section 5 is ready for printing in step Si (Yes), the controlling device 100 may transmit the driving force to the pick-up roller 8 to feed the first sheet 3 to the image forming section 5 (step S2).

Thereafter, the controlling device 100 may determine whether the first sheet sensor 110 may detect the trailing end of the sheet 3 (step S3). When the controlling device 100 determines that the first sheet sensor 110 detects the trailing end of the sheet 3 in step S3 (Yes), the controlling device 100 may start feeding the next sheet 3, e.g., a second sheet 3, after waiting for the sheet feed waiting interval that is currently set (step S4).

The sheet feed waiting interval, e.g., the time since the trailing end of the first sheet 3 to feed the next sheet 3, may be set to the initial value, e.g., the above-described predetermined time. If the sheet feed waiting interval is changed to feed the third and subsequent sheets 3, as will be described in detail below, the controlling device 100 may start feeding the sheet 3 in the changed feeding timing in step S4.

After step S4, the controlling device 100 may determine whether the second sheet sensor 120 detects the sheet interval (step S5). More specifically, the controlling device 100 may determine in step S5 whether the second sheet sensor 120 detects the leading end of the next the sheet 3 after the second sheet sensor 120 detects the trailing end of the previous sheet 3.

When the controlling device 100 determines that the sheet interval is detected in step S5 (Yes), the controlling device 100 may proceed to a feeding timing resetting processing (step S6). In the feeding timing resetting processing as depicted in FIG. 3, the controlling device 100 may calculate the sheet interval (step S11).

In this embodiment, every time the controlling device 100 detects the sheet interval in step S5, the controlling device 100 may calculate the sheet interval in step S11.

After step S11, the controlling device 100 may determine whether the sheet interval is equal to or greater than the reference value (step S 12). When the controlling device 100 determines that the sheet interval is equal to or greater than the reference value in step S12 (Yes), the controlling device 100 may change the feeding timing, for example, by reducing the sheet feed waiting interval (step S13).

When the controlling device 100 determines that the sheet interval is less than the reference value in step S12 (No), the controlling device 100 may leave the feeding timing unchanged. Then, the controlling device 100 may end the feeding timing resetting processing.

Referring back to FIG. 2, after the controlling device 100 ends the feeding timing resetting processing in step S6, the controlling device 100 may determine whether the printing operation is finished (step S7). When the controlling device 100 determines that the printing operation is not finished in step S7 (No), the controlling device 100 may return to step S3.

When the controlling device 100 determines that the printing operation is finished in step S7 (Yes), the controlling device 100 may reset the sheet feed waiting interval to the initial value (S8). Then, the controlling device 100 may end the operations.

While the disclosure has been described in detail with reference to the specific embodiment thereof, this is merely an example, and various changes, arrangements and modifications may be applied therein without departing from the spirit and scope of the disclosure.

In the above embodiment, after the controlling device 100 calculates one sheet interval, the controlling device 100 may compare the calculated one sheet interval with the reference value immediately or soon after the calculation. However, the controlling device 100 may be configured, for example, to store a plurality of calculated sheet intervals, based on which the controlling device 100 may obtain or derive one sheet interval. The controlling device 100 may be configured to compare the obtained one sheet interval with the reference value.

In such embodiments, because the controlling device 100 obtains or drives one sheet interval based on a plurality of the sheet intervals, a proper sheet interval may be employed even when an irregular or exceptional event, e.g., a slip between rollers and the sheet 3, may happen. In other words, even when the second sheet sensor 120 detects the sheet interval that will greatly differ from the expected sheet interval, the proper sheet interval may be employed without being confused by one irregular or exceptional value.

Figure 4:
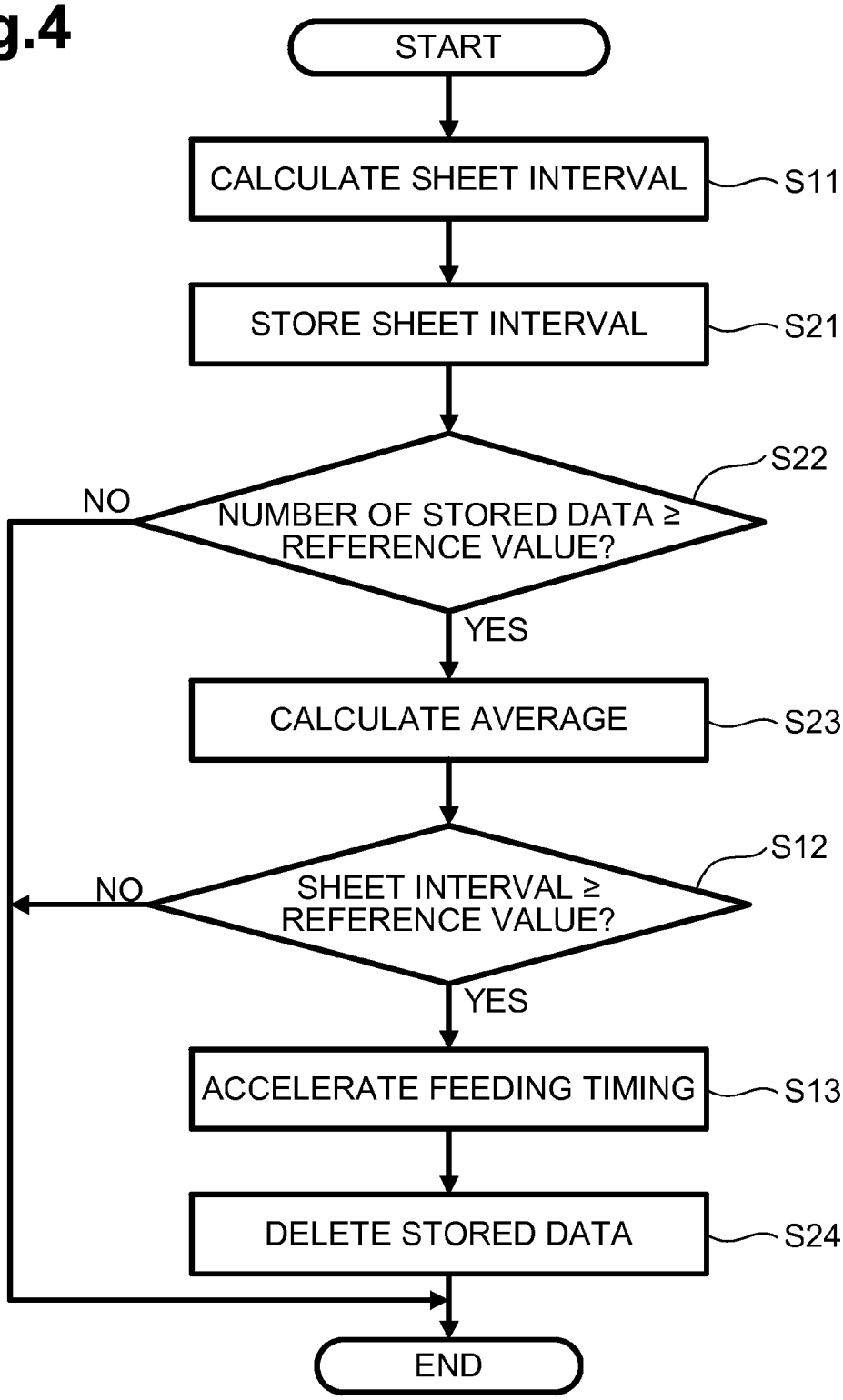
FIG. 4 is a flowchart depicting a modification of processes of the feeding timing resetting processing.

To obtain or derive one sheet interval based on a plurality of the sheet intervals and apply the obtained one sheet interval, the controlling device 100 may be configured to perform, for example, processing depicted in the flowchart of FIG. 4, in the feeding timing resetting processing performed in step S6 in the above embodiment. More specifically, the controlling device 100 may calculate the sheet interval (step S11), similar to the above embodiment. Thereafter, the controlling device 100 may store the calculated sheet interval in a memory (step S21).

After step S21, the controlling device 100 may determine whether the number of the stored sheet intervals, i.e., pieces of the stored data, is equal to or greater than a predetermined number (step S22). When the controlling device 100 determines that the number of the stored sheet intervals is equal to or greater than a predetermined number in step S22 (Yes), the controlling device 100 may calculate an average of a plurality of the stored sheet intervals (step S23). That is, the controlling device 100 may obtain or derive one sheet interval based on a plurality of the sheet intervals.

After step S23, the controlling device 100 may perform the same processes as steps S12 and S13 in the above embodiment. That is, the controlling device 100 may determine whether the calculated one sheet interval, i.e. the average, is equal to or greater than the reference value (step S12). When the controlling device 100 determines that the calculated one sheet interval is equal to or greater than the reference value in step S12 (Yes), the controlling device 100 may reduce the sheet feed waiting interval (step S13).

After step S13, the controlling device 100 may delete the stored sheet intervals, i.e., pieces of the stored data, from the memory (step S24). Then, the controlling device 100 may end the feeding timing resetting processing. When the controlling device 100 determines that the number of the stored sheet intervals is less than the predetermined number in step S22 (No), or the controlling device 100 determines that the sheet interval is less than the reference value in step S12 (No), the controlling device 100 may end the feeding timing resetting processing without changing the feeding timing.

One sheet interval may be obtained or derived based on all of a plurality of the sheet intervals in the processing in FIG. 4. In alternative embodiments, the controlling device 100 may be configured to obtain or derive one sheet interval based on a part of a plurality of the sheet intervals, but may exclude the maximum and minimum sheet interval values.

Figure 5:
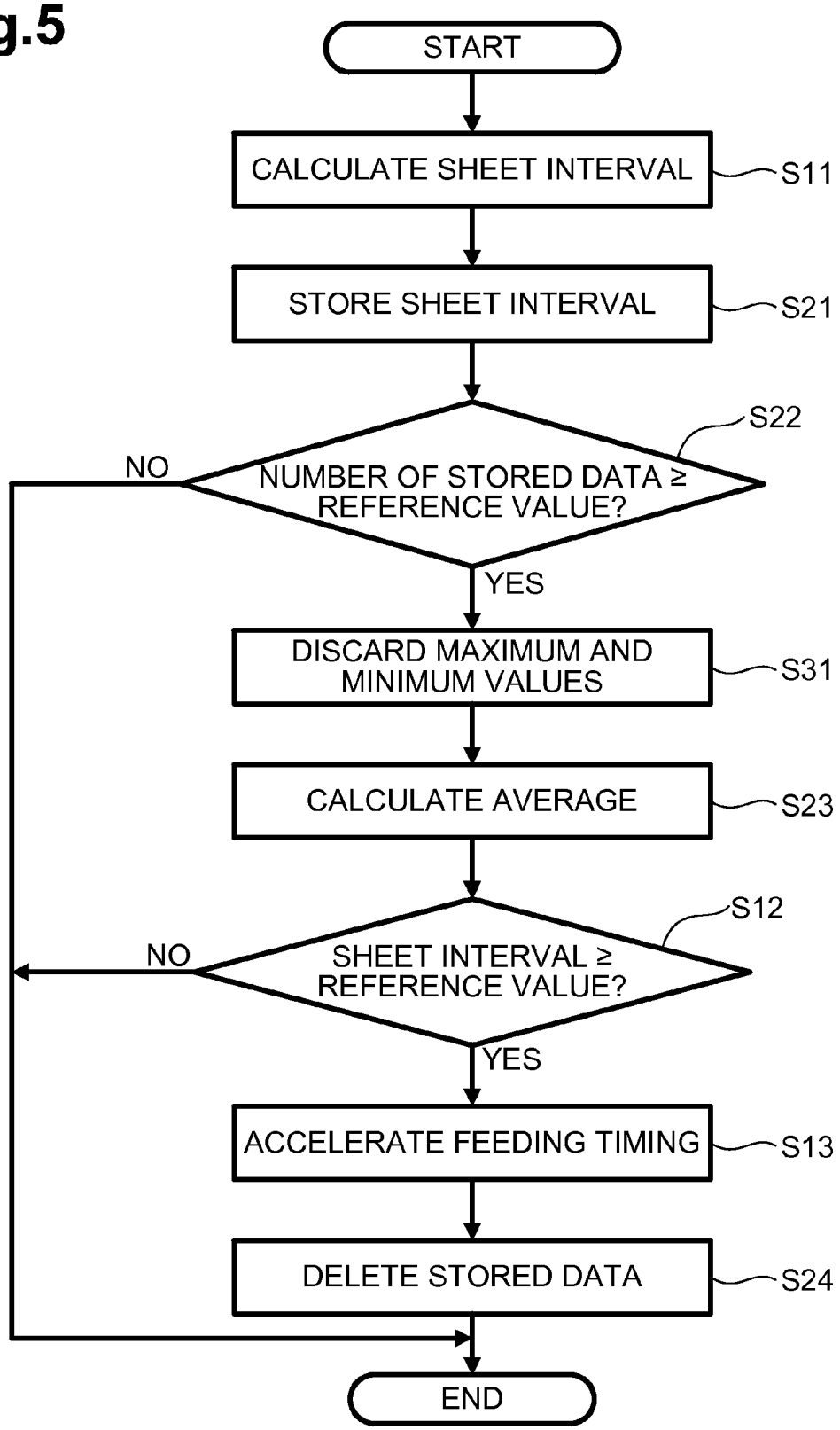
FIG. 5 is a flowchart depicting another modification of processes of the feeding timing resetting processing.

The maximum and minimum values that may be irregularly detected by the second sheet sensor 120 may be ignored to obtain one sheet interval. Therefore, a proper sheet interval may be obtained. To obtain or derive one sheet interval based on a part of a plurality of the sheet intervals, exclude the maximum and minimum sheet interval values and apply the obtained sheet interval, the controlling device 100 may be configured to perform, for example, an additional process in step S31 to discard the maximum and minimum values, as depicted in FIG. 5, between steps S22 and S23 in the feeding timing resetting processing depicted in in FIG. 4.

In the above embodiment, the timing roller may be the pick-up roller 8. Alternatively, the timing roller may be other rollers, such as the registration roller 12.

In the above embodiment, the detection member may be the second sheet sensor 120. Alternatively, the detection member may be other members, such as the first sheet sensor 110.

In the above embodiment, the calculating and controlling devices may be structured by the one controlling device 100. Alternatively, the calculating and controlling devices may be separately structured.

In the above embodiment, the laser printer 1 may comprise the sheet supply device, e.g., the feeder section 4. Alternatively, other image forming apparatuses, e.g., copiers or multi-function devices configured to operate as a facsimile, a copier, a printer, or a scanner, or any combination thereof, or a document reading device configured to read a document or a sheet may comprise the sheet supply device.

In the above embodiment, the trailing end of the previous sheet 3 and the leading end of the next sheet 3 may be referred to as the sheet interval. Alternatively, the leading end of the previous sheet 3 and the leading end of the next sheet 3 may be referred to as a sheet interval if a controlling device 100 is able to determine the length of a sheet.

As depicted in the flowcharts of FIGS. 4 and 5, as a method to obtain one sheet interval from a plurality of the sheet intervals, an average may be calculated. Alternatively, for example, an intermediate value may be selected from a plurality of sheet intervals as a sheet interval.

In the above embodiment, the sheet placing portion may be the sheet supply tray 6. Alternatively, the sheet placing portion may be other portions, for example, a manual feeding tray.

In the above embodiment, the photosensitive member may be the photosensitive drum 27. Alternatively, the photosensitive member may be other types of photosensitive members, for example, a belt-shape photosensitive member.

In the above embodiment, the transfer member may be the transfer roller 30. Alternatively, the transfer member may be other types of transfer members, for example, a conductive brush or a conductive plate spring, to which transfer bias may be applied.

What is claimed is:

1. An image forming device comprising:

a roller configured to rotate and to convey a sheet in a conveying direction;

an image forming unit configured to form an image on the sheet conveyed by the roller;

a sensor disposed between the roller and the image forming unit in the conveying direction and configured to detect the sheet;

a photosensitive member;

a transfer member facing the photosensitive member; and a control device configured to:

upon feeding a sheet by the roller, waiting for a sheet feed waiting interval before feeding a next sheet by the roller;

determine, using the sensor, a sensed sheet interval between at least two of the fed sheets;

determine whether the sensed sheet interval is equal to or greater than a reference value; and in response to determining that the sensed sheet interval is equal to or greater than the reference value, reduce the sheet feed waiting interval for subsequent feeding of at least one sheet, wherein the control device is configured to reset the sheet feeding waiting interval to an initial value when a print operation is finished.

2. A non-transitory, computer-readable medium storing a program comprising instructions for performing the steps of:

upon feeding a sheet by a roller, waiting for a sheet feed waiting interval before feeding a next sheet by the roller;

determining, using a sensor downstream from the roller in a sheet feeding path, a sensed sheet interval between at least two of the fed sheets;

determining whether the sensed sheet interval is equal to or greater than a reference value; and in response to determining that the sensed sheet interval is equal to or greater than the reference value, reducing the sheet feed waiting interval for subsequent feeding of at least one sheet, the instructions further comprising instructions for resetting the sheet feeding waiting interval to an initial value when a print operation is finished.

* * * * *